US010233699B2

(12) United States Patent
Backer et al.

(10) Patent No.: US 10,233,699 B2
(45) Date of Patent: Mar. 19, 2019

(54) COILED TUBING MAST AND METHOD OF SERVICING A WELL

(71) Applicant: SG HOLDINGS I LLC, Oklahoma City, OK (US)

(72) Inventors: Raymond F. Backer, Calgary (CA); Matthew A. Lucas, Calgary (CA); Robert J. Gemmell, Calgary (CA)

(73) Assignee: SG HOLDINGS I LLC, Oklahoma City, OK (US)

( * ) Notice: Subject to any disclaimer, the term of this patent is extended or adjusted under 35 U.S.C. 154(b) by 250 days.

(21) Appl. No.: 15/106,619

(22) PCT Filed: Dec. 23, 2014

(86) PCT No.: PCT/US2014/072272
§ 371 (c)(1),
(2) Date: Jun. 20, 2016

(87) PCT Pub. No.: WO2015/100380
PCT Pub. Date: Jul. 2, 2015

(65) Prior Publication Data

US 2017/0022764 A1 Jan. 26, 2017

Related U.S. Application Data

(60) Provisional application No. 61/920,968, filed on Dec. 26, 2013.

(51) Int. Cl.
*E04H 12/18* (2006.01)
*E21B 15/00* (2006.01)
(Continued)

(52) U.S. Cl.
CPC ..... *E21B 15/003* (2013.01); *E04H 12/18* (2013.01); *E04H 12/182* (2013.01);
(Continued)

(58) Field of Classification Search
CPC ..... E21B 19/08; E21B 19/086; E21B 19/22; E21B 15/003; E21B 44/00; E04H 12/18; E04H 12/182; E04H 12/187
See application file for complete search history.

(56) References Cited

U.S. PATENT DOCUMENTS 4,823,870 A * 4/1989 Sorokan ..... E21B 15/003 166/79.1
6,003,598 A * 12/1999 Andreychuk ..... E21B 19/22 166/76.1

(Continued)

FOREIGN PATENT DOCUMENTS

CA 2279148 A1 * 1/2000 ..... E21B 15/00
CA 2934532 A1 * 7/2015 ..... E21B 19/22

OTHER PUBLICATIONS

International Search Report and Written Opinion of the International Searching Authority dated Apr. 22, 2015 filed in related application PCT/US2014/072272.

*Primary Examiner* — Jennifer H Gay
(74) *Attorney, Agent, or Firm* — McAfee & Taft

(57) ABSTRACT

In coiled tubing operations, a mast system is provided which allows for performing coiled tubing operations for multiple wells without repositioning the mast or reel of coiled tubing. The system has a telescoping mast, which is rotationally mounted on a transportable base. The mast is also pivotally attached to the base such that it can be tilted with respected to the base. Further, the mast includes a crown having a receptor configured to receive a coiled tubing injector, wherein the receptor can be rotated and tilted with respect to the mast.

15 Claims, 15 Drawing Sheets

(51) Int. Cl.
*E21B 19/08* (2006.01)
*E21B 19/22* (2006.01)

(52) U.S. Cl.
CPC ..... *E04H 12/187* (2013.01); *E21B 19/08* (2013.01); *E21B 19/22* (2013.01)

(56) References Cited

U.S. PATENT DOCUMENTS

| | | | | |
|---|---|---|---|---|
| 6,431,286 | B1 * | 8/2002 | Andreychuk | E21B 19/22 166/384 |
| 2006/0163415 | A1 * | 7/2006 | Geddes | B65H 75/4413 242/563 |
| 2006/0231267 | A1 | 10/2006 | Wood | |
| 2007/0209791 | A1 * | 9/2007 | Havinga | E21B 7/02 166/77.2 |
| 2007/0295497 | A1 | 12/2007 | Pleskie et al. | |
| 2010/0038088 | A1 * | 2/2010 | Springett | E21B 15/003 166/313 |
| 2013/0180186 | A1 * | 7/2013 | Konduc | E21B 15/00 52/119 |
| 2013/0269268 | A1 * | 10/2013 | Thiessen | E21B 15/00 52/118 |
| 2013/0341038 | A1 * | 12/2013 | Flusche | E21B 19/00 166/379 |
| 2015/0152690 | A1 * | 6/2015 | Sorokan | E21B 7/02 175/57 |
| 2017/0022764 | A1 * | 1/2017 | Backer | E21B 19/22 |

* cited by examiner

COILED TUBING MAST AND METHOD OF SERVICING A WELL

CROSS-REFERENCE TO RELATED APPLICATIONS

This application claims the benefit of U.S. Provisional Application No. 61/920,968 filed Dec. 26, 2013, which is hereby incorporated by reference.

FIELD OF THE INVENTION

This invention relates to methods and apparatuses for performing earth borehole or wellbore operations. In particular, this invention relates to coiled tubing operations on wells and to coiled tubing injector systems used in introducing coiled tubing into wellbores.

BACKGROUND OF THE INVENTION

The use of coiled tubing technology in oil and gas drilling and servicing has become more and more common in the last few years. In coiled tubing technology, a continuous pipe wound on a spool is straightened and pushed down a well using a coiled tubing injector. Coiled tubing technology can be used for both drilling and servicing operations.

The advantages offered by the use of coiled tubing technology, including economy of time and cost, are well known. As compared with jointed-pipe technology wherein typically 30-45 foot straight sections of pipe are threadedly connected one section at a time, coiled tubing technology allows a continuous deployment of pipe, significantly reducing the frequency with which pipe insertion into the well must be suspended to allow additional sections of pipe to be connected. This results in less connection time, and as a result, an efficiency of both cost and time. Coiled tubing technology also allows fluid to be continuously circulated downhole while inserting the tubing in the well, thereby significantly reducing the likelihood of stuck tubing.

During wellbore servicing operations utilizing coiled tubing, there has been a need to increase and improve safety, operational effectiveness, reduce inefficiencies and decrease downtime that can be caused by moving from one wellhead to another. Over the years, the coiled tubing injectors along with the blow out preventers (BOPs) and subsequent tooling were hung from a crane or placed on the back of a telescoping truck or trailer unit. Unfortunately, conventional units require relocation of the entire crane-injector system for each well. Typically, it has taken about 10 to 12 hours to move such crane-injector systems from one well to another, including dismantling at the first wellhead and setting up the system at the subsequent wellhead. For oil and gas wells, the delay in servicing the well due to moving the crane-injector system can result in significant costs.

SUMMARY OF THE INVENTION

In one embodiment, the present invention provides for a method of servicing a well comprising:

(a) mounting a coiled tubing injector onto a mast unit comprising a transportable base, a telescoping mast rotationally mounted upon the base and a crown configured to accept the injector, wherein the telescoping mast can be tilted with respect to the base and the crown is adjustable so as to tilt and rotate the injector;

(b) introducing a tubing from a reel of coiled tubing to the injector;

(c) orienting the injector to be in-line with a first wellhead by one or more of tilting the mast, telescoping the mast and rotating the mast; and (d) orienting the injector by adjustment of the crown, simultaneously with step (c), to maintain an in-line feed orientation of tubing between the injector and the reel.

In another aspect, the method further comprising leveling the mast unit prior to introducing the tubing in step (b). Additionally, the method can comprise calibrating the crown with respect to the reel such that a zero point is established in which the injector has the in-line feed orientation with the reel. Also, the reel can rotate to provide tubing to the injector and has an orientation defined by the reel's direction of rotation. The in-line feed orientation can vary no more than 10 degrees from the orientation of the reel.

In yet another aspect, the method can includes automatically orienting the injector to maintain the in-line feed orientation during orientation of the injector to be in-line with the first wellhead. Also in this aspect, the method can include automatically leveling the crown during the orientation of the injector to be in-line with the first wellhead such that the injector maintains a vertical injection orientation.

In still another aspect, prior to step (a), the reel is positioned in-line with respect to a row formed by a plurality of wellheads comprising the first wellhead and a second wellhead, and the base is positioned at the side of the row.

In a further aspect, the method further comprises the steps of:

(e) carrying out a coiled tubing operation on the first wellhead;

(f) after step (e), orienting the injector to be in-line with the second well by one or more of tilting the mast, telescoping the mast and rotating the mast; and (g) orienting the injector by adjustment of the crown, simultaneously with step (f), to maintain an in-line feed orientation of tubing between the injector and the reel; and (h) carrying out a coiled tubing operation on the second wellhead.

Additionally, steps (f) through (h) can be repeated for each subsequent wellhead in the row. Also, steps (a) through (h) can be carried out without repositioning the base of the mast unit.

In another embodiment, the invention provides for a mast system for use in coiled tubing operations. The mast unit comprises a transportable base, a telescoping mast, a crown and a control unit. The telescoping mast has a first end and second end. The first end is rotationally mounted on the base. The mast is pivotally attached to the base such that it can be tilted with respected to the base. The crown has a receptor configured to receive a coiled tubing injector. The receptor can be rotated and tilted with respect to the mast. The control unit is configured to rotate and tilt the receptor in relation to movement of the mast.

In another aspect, the mast system can further comprise an injector and a reel of coiled tubing with the tubing extending into the injector. The control unit is configured to orient the injector by rotating and tilting the receptor to maintain an in-line feed orientation of tubing between the injector and the reel simultaneously with the injector is oriented to be in-line with a wellhead by one or more of tilting the mast, telescoping the mast and rotating the mast.

In yet another aspect, the mast system can additionally comprise a plurality of wellheads including the first wellhead and a second wellhead. Generally, the reel can be positioned in-line or at an angle to the plurality of wellheads; however, it is preferred that the reel is positioned in-line with respect to a row formed by the plurality of wellheads and the base is positioned aside the row.

BRIEF DESCRIPTION OF THE DRAWINGS

FIG. 6 is a perspective view of the mast unit of FIG. 2 illustrated with the telescoping mast extended and elevated. The mast is shown swiveled or rotated around to the side approximately 120 degrees from its position in FIG. 2.

FIG. 8 is a perspective view of the crown of the mast unit of FIGS. 2-7.

FIG. 9 is a perspective view of the mast unit of FIG. 2 shown in its contracted, lowest position with its outriggers shown in their extended position.

FIG. 12 is a further schematic illustration of the mast system as it is being set up for well servicing. FIG. 12 shows the injector having been attached to the crown of the mast unit.

FIG. 13 is yet another schematic illustration of the mast system as it is being set up for well servicing. FIG. 13 illustrates the connection of lubricators.

FIG. 16 is a schematic illustration of the mast system as it is servicing a fifth well in a line of wells.

DESCRIPTION OF THE INVENTION

Figure 1:
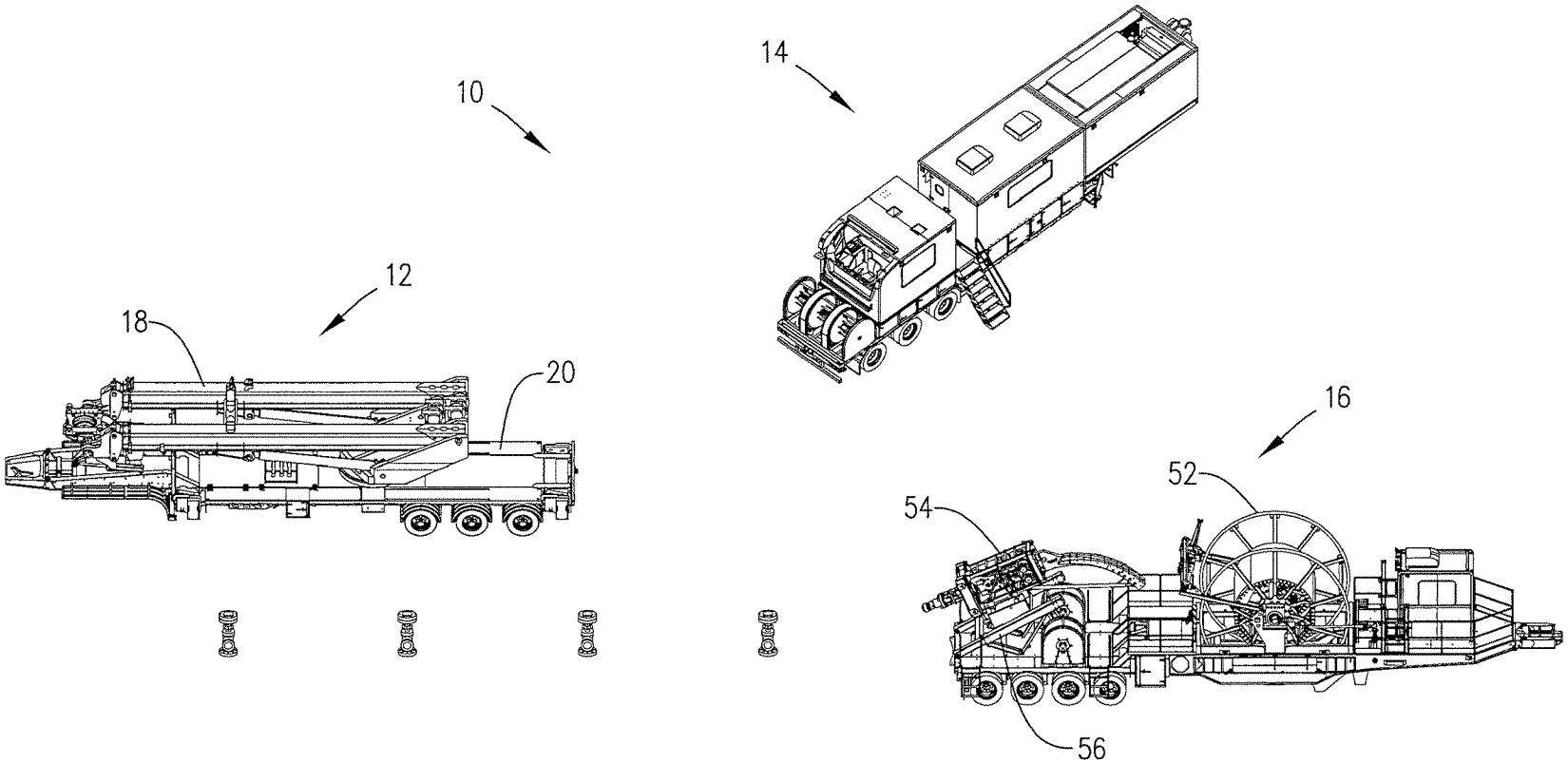
FIG. 1 is a schematic representation of a mast system and line of wells in accordance with some embodiments.
Figure 2:
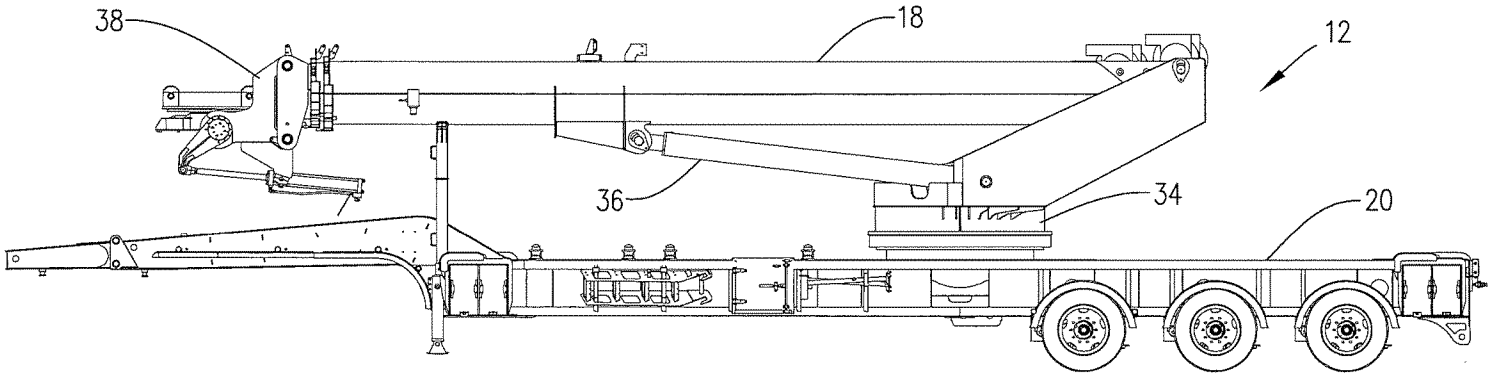
FIG. 2 is a side view of a mast unit in accordance with some embodiments. The telescoping mast is shown in its unextended, lowest position as situated for movement of the mast unit.
Figure 3:
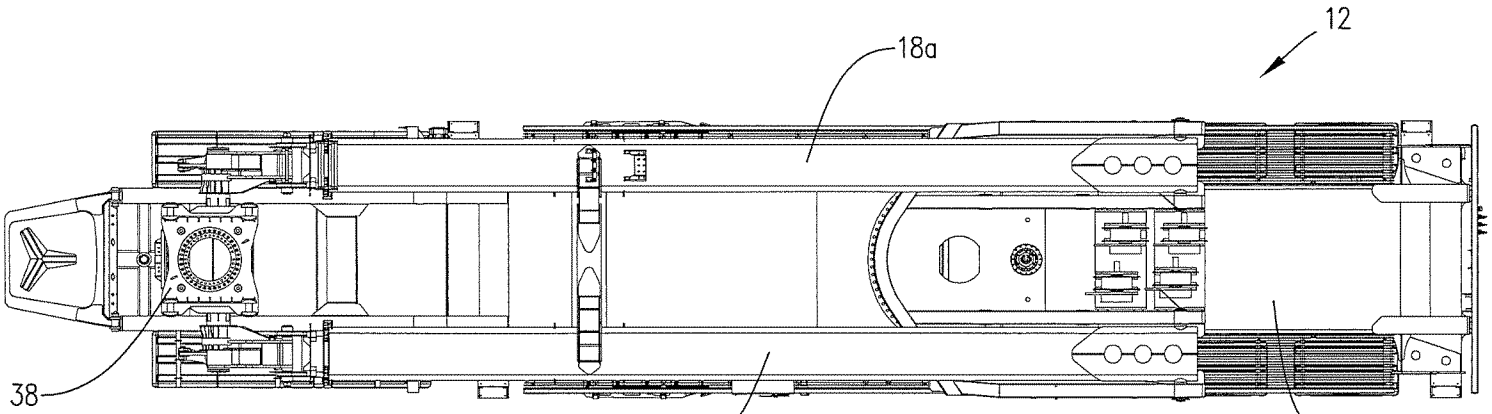
FIG. 3 is a top view of the mast unit of FIG. 2
Figure 4:
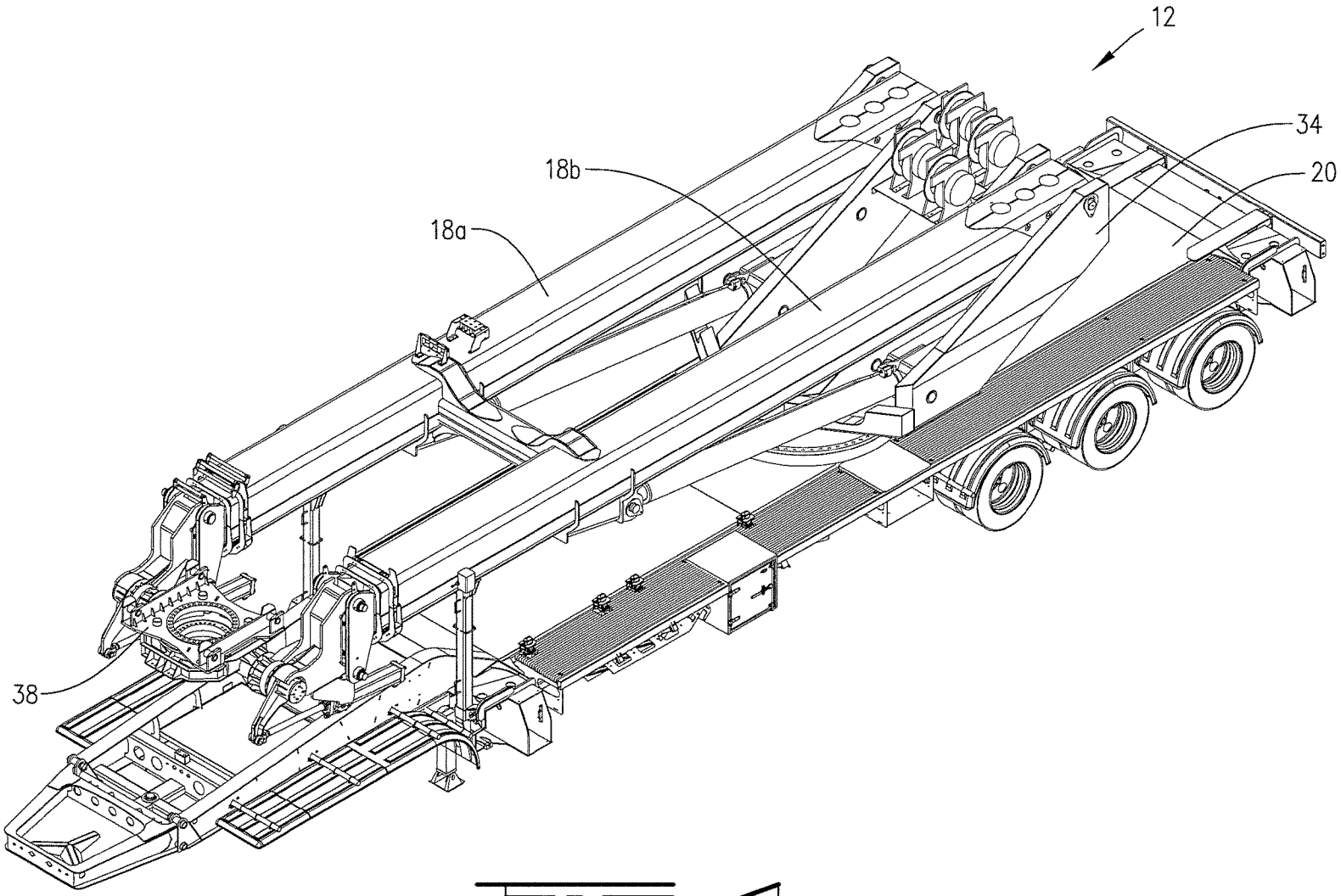
FIG. 4 is a perspective view of the mast unit of FIG. 1
Figure 3:
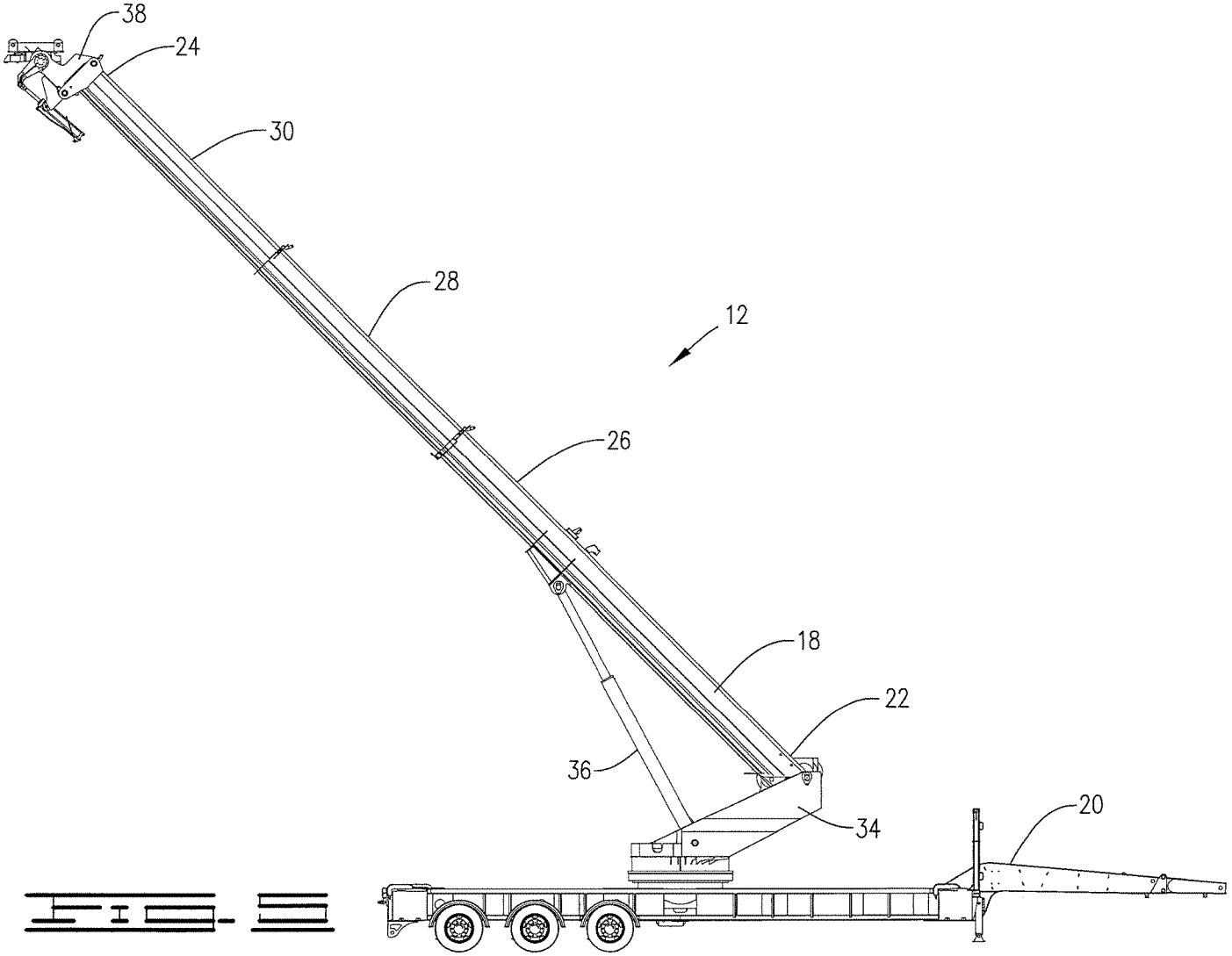

Referring now to the drawings, wherein like reference numbers are used herein to designate like elements throughout the various views, various embodiments are illustrated and described. The figures are not necessarily drawn to scale, and in some instances the drawings have been exaggerated and/or simplified in places for illustrative purposes only. In the following description, the terms "inwardly" and "outwardly" are directions toward and away from, respectively, the geometric center of a referenced object. Where components of relatively well-known designs are employed, their structure and operation will not be described in detail. One of ordinary skill in the art will appreciate the many possible applications and variations of the present invention based on the following description.

The current mast system for use in coiled tubing operations comprises a transportable base, a telescoping mast, a crown and a control unit. The telescoping mast has a first end and second end, wherein the first end is rotationally mounted on the transportable base. The mast is also pivotally attached to the base such that it can be tilted with respect to the base. The crown has a receptor configured to receive a coiled tubing injector, wherein the receptor can be rotated with respect to the crown and/or mast to thus rotate the injector. Additionally, the crown or the receptor can be tilted to thus tilt the injector. The control unit is configured to rotate and/or tilt the receptor in relation to movement of the mast.

The embodiments of the current system allow the operator to place the transportable base and mast once for multiple wells without subsequent moving or adjusting of the transportable base. Rather, once the transportable base is set, the mast can be oriented for each well; that is, it can be lowered, raised, rotated or telescoped to reposition the injector to be functionally positioned relative to the well. When the injector is functionally positioned relative to the well, it will generally be in-line with the wellhead; that is, it will feed tubing in a substantially straight line into the wellhead. Simultaneously with the orientating of the mast, the injector is oriented to maintain a straight line with a coil of coiled tubing; that is, the injector has an in-line feed orientation with the reel. As used in relation to the coil of coiled tubing, the term "in-line feed orientation" means that the injector receives the tubing along a line from coil or reel such that there are no substantial bends in the tubing between the coil and reel. This means that the gooseneck or guide arch of the injector is substantially oriented towards the reel along a line tangential to the direction of rotation of the reel. Generally, the gooseneck of the injector and the reel are oriented such that the line of tube from the reel to the tube inlet varies no more than 10 degrees from the tangential line and, more preferably, no more than 5 degrees or 2 degrees, The above embodiment increases safety of onsite personnel, saves the drilling company wasted time in relocating the mast, injector and reel of coiled tubing and increases the overall efficiency of the site. Embodiments of the current system can move the mast and injector from a first well to a second well in a period of time of about 1 to 2 hours, representing a significant time and cost savings.

Turning now to FIG. 1, a mast system 10 in accordance with one embodiment is shown. The mast system 10 can comprise a mast unit 12, a control unit 14 and coil unit 16. As shown, mast unit 12 is a telescoping mast 18 mounted on a trailer 20; however, the telescoping mast 18 can be mounted on any suitable transportable base, such as a trailer, truck or skid. As used herein "telescope" or "telescoping" means to cause to slide inward or outward in overlapping sections. As can be seen from FIG. 5, telescoping mast 18 has telescoping sections 26, 28 and 30, which overlap and slide into one another.

Mast unit 12 can be better seen with reference to FIGS. 2-7. As can be seen, telescoping mast 18 can have two telescoping mast members or legs 18*a* and 18*b*. Telescoping legs 18*a* and 18*b* are attached at first end 22 to base 34 and at a second end 24 to a crown 38. Each leg 18*a* or 18*b* is made of telescoping sections 26*a*, 28*a* and 30*a* or 26*b*, 28*b* and 30*b*, respectively. While generally both legs 18*a* and 18*b* will be telescoped together, i.e. simultaneously and in the same amount, they can also be telescoped out independently of each other to position crown 38 as needed. The degree of independent telescoping of legs 18*a* and 18*b* is limited by the attachment of legs 18*a* and 18*b* to crown 38. It will be appreciated that independent telescoping of legs 18*a* and 81*b* will result in tilting of crown 38.

As indicated above, a first end 22 of telescoping mast 18 is mounted on a base 34, which is a rotating base. Rotating base 34 is thus pivotally attached to a transportable support, such as trailer 20, so that it can be rotated in a horizontal plane 360°, as is illustrated by a comparison of FIG. 5, FIG. 6 and FIG. 7. Rotating base 34 thus rotates telescoping mast 18. Any suitable motor (not shown) can rotate base 34.

Figure 5:
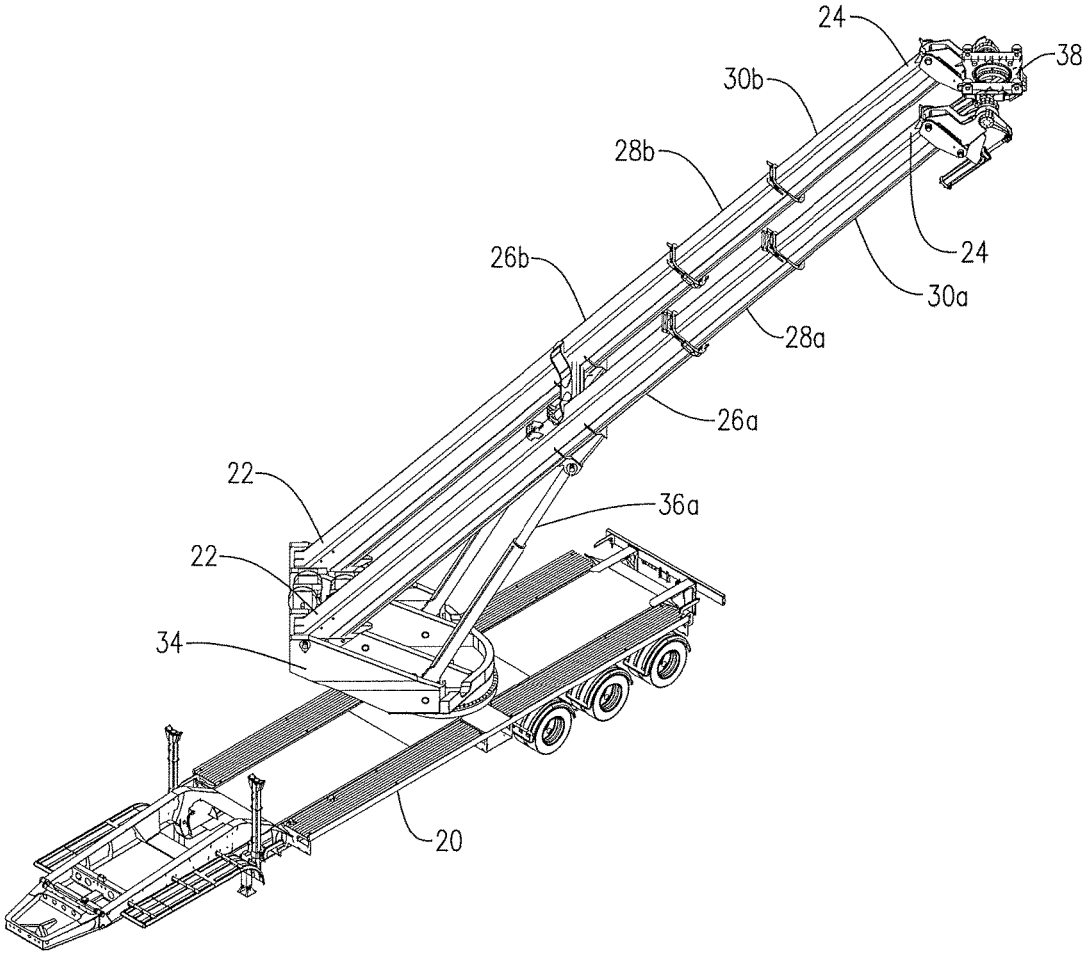
FIG. 5 is a side view of the mast unit of FIG. 2 illustrated with the telescoping mast extended and elevated. The mast is shown swiveled or rotated around 180 degrees from its position in FIG. 2.
Figure 7:
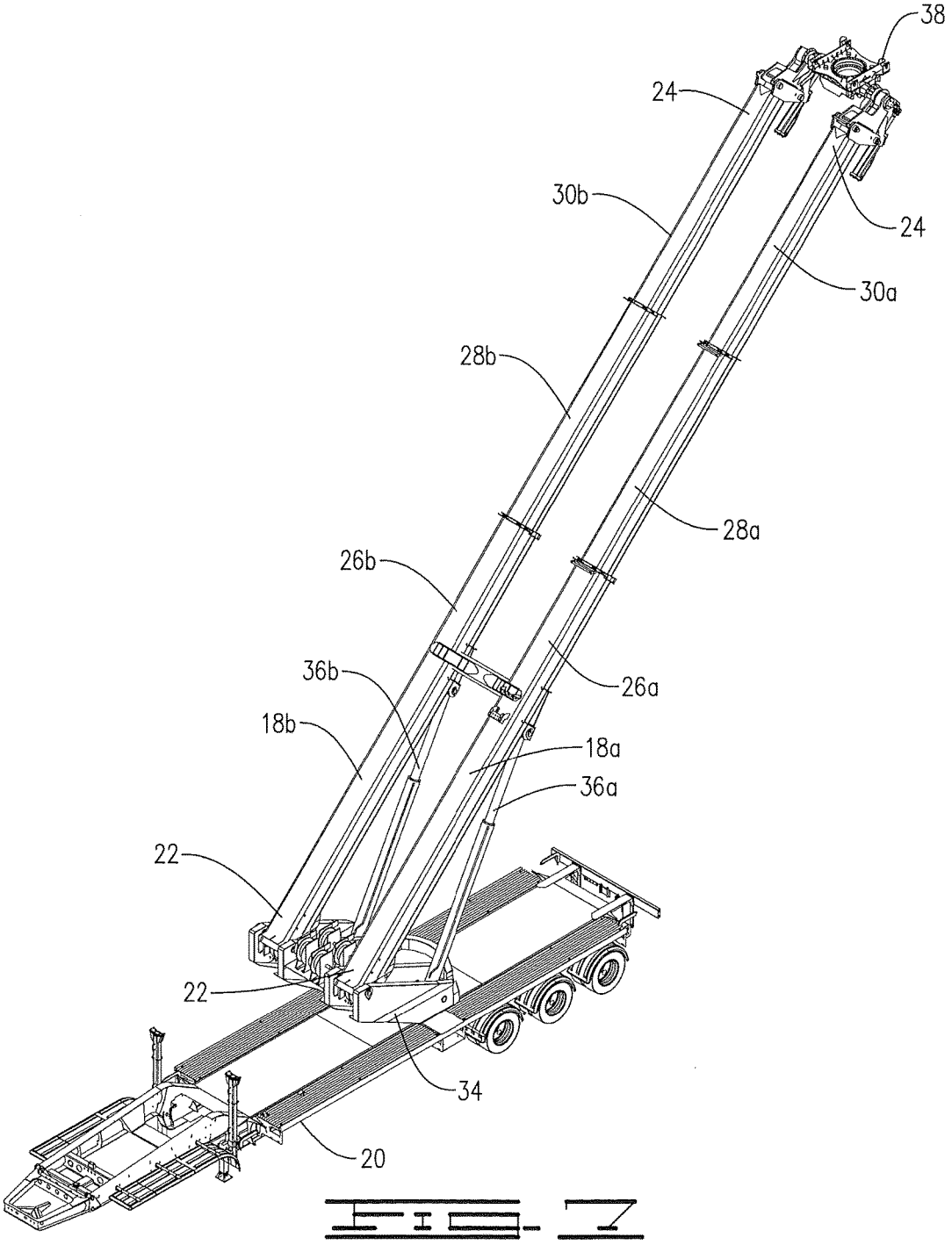
FIG. 7 is a perspective view of the mast unit as illustrated in FIG. 5.
Figure 7:
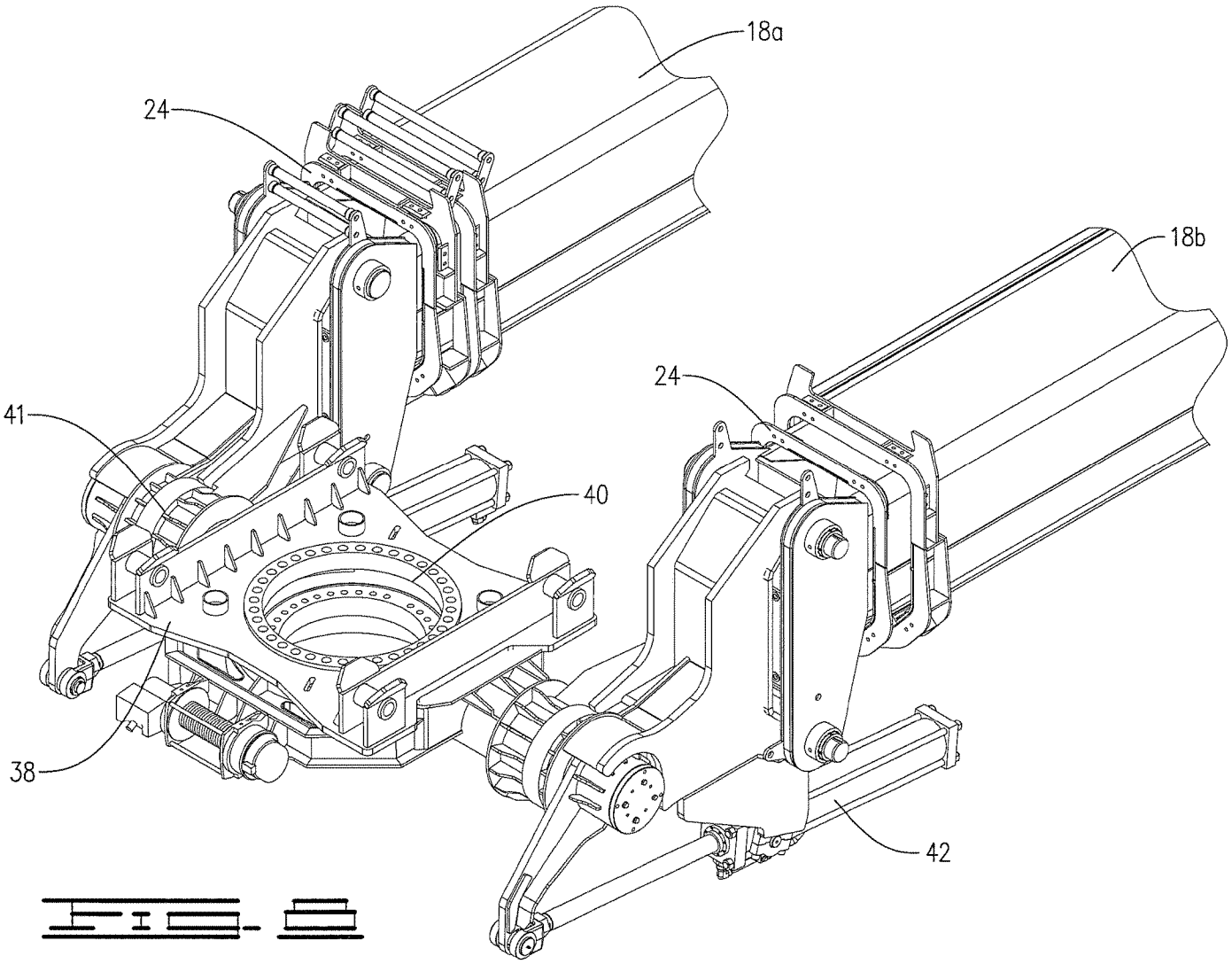
Figure 3:
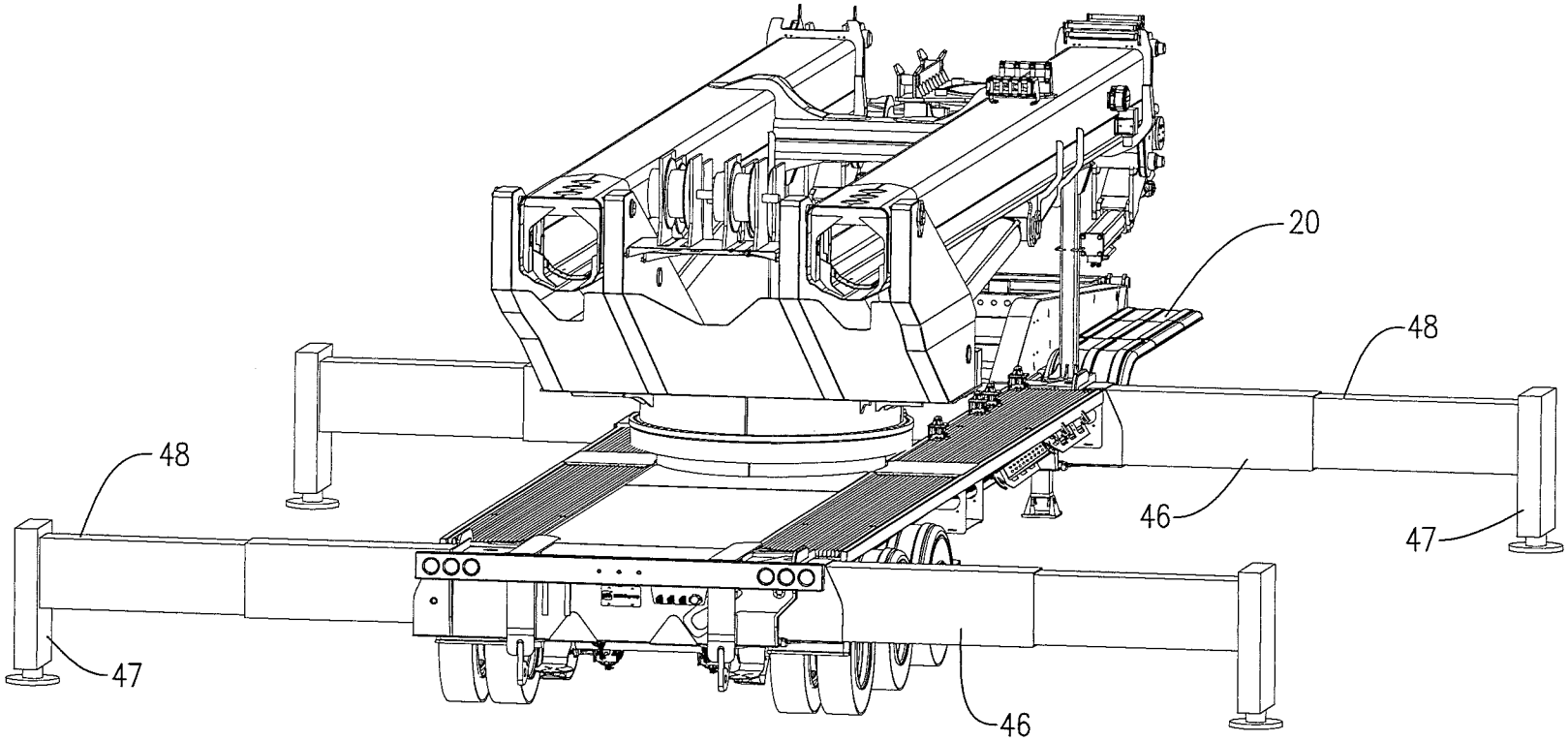

Additionally, first end 22 is attached to base 34 so that it can be tilted vertically to pivotally lift telescoping mast 18 so that second end 24 can be lifted or lowered vertically. Pistons 36 can tilt telescoping mast 18 vertically. Generally, there will be a piston 36*a* and 36*b* associated with each mast leg 18*a* and 18*b*. Each piston can be actuated independently, but independent elevation of legs 18*a* and 18*b* is limited by the attachment to crown 38. As will be appreciated, the independent movement of the telescoping action of each leg and the vertical tilt action of each piston 36 will result in a tilting of crown 38, and thus, allows for leveling of crown 38 even when trailer 20 is not positioned on level ground. FIG. 1 shows telescoping mast 18 in its lowest position and FIGS. 5-7 shown telescoping mast 18 in a raised position.

As best seen from FIG. 8, second end 24 of mast 18 terminates in a crown 38, which has a receptor 40 configured to receive a coiled tubing injector. Receptor 40 can be rotated with respect to crown 38 and/or telescoping mast 18. Receptor 40 can rotate 360° with respect to crown 38. Typically, a coiled tubing injector locks into receptor 40 and is rotated by means of a gear 41 associated with receptor 40. Gear 41 can be rotatable by means of being the worm gear of a slew drive system.

Further, crown 38 can be tilted with respect to telescoping mast 18 by means of a tilter, such as a piston system 42 or rotors, which can be, for example, dual worm gear slew drives. Piston system 42 tilts the crown with respect to the vertical axis allowing crown 38 to tilt forward (away from the mast) or backwards (towards the mast), Accordingly, by tilting the crown 38 and rotating an injector in the receptor 40 the injector can remain in-line with the wellhead and maintain in-line feed orientation with the reel of coiled tubing, as further described below.

Additionally, crown 38 can have a winch 44 to aid in the movement of blow out preventers (BOPs) and other tooling to support the coiled tubing operations. Further, as can be best seen from seen from FIG. 9, trailer 20 has outriggers 48, which can telescope out from trailer 20 and can extend towards the ground for leveling and stability. Thus, outriggers 48 have a contracted position where arms 46 are withdrawn to trailer 20 and feet 47 are not in contact with the ground. In addition, outriggers 48 have an extended position where arms 46 are extended from the trailer and feet 47 are in contact with the ground.

Referring again to FIG. 1, coil unit 16 will typically have coiled tubing 50 (best seen from FIGS. 10-16) on a reel 52. It can also have the injector 54 mounted on a mini mast 56, which allows vertical movement of the injector 54 to facilitate mounting in receptor 40 of crown 38.

Control unit 14 is generally a mobile or trailer mounted computer control unit, which is connected to mast unit 12 to control its operation. Generally, the connection will be a wireless connection. Control unit 14 can be programmed to automatically level and coordinate the rotation and extension of the components of mast unit 12; however, it can also be configured to allow manual control of mast unit 12. Configuration of such a control unit is within one skilled in the art based on this disclosure.

The above described mast system 10 provides a system where the injector, lubricator(s), Blow Out Preventer (BOP) and associated tooling required for any specific job can be easily and safely lifted above the wellhead. Features of the mast system 10 include:

- full remote control from command trailer or control unit 14;
- the telescoping mast 18 has a 360° rotating base 34 with the telescoping mast 18 providing service to multiple wellheads without relocating;
- service area can be front, back, left or right, or anywhere within the load radius of mast unit 12;
- crown 38 can include an injector locking mechanism, which is able to lock and release the injector from the crown;
- crown 38 is able to auto-level in multiple directions;
- along with auto-leveling, the crown 38 is able to automatically position itself in-line with the reel 52 and drill string or coiled tubing 50; and
- auto-positioning of crown 38 allows the injector and the associated tooling to remain in-line with the drill string using vertical and rotational directional control.

The mast system 10, its operation and the above advantages will now be further described with reference to FIGS. 10-16. First, mast unit 12 is leveled at time of initial rig up using the outriggers 48. Typically, the outriggers are controlled at mast unit 12; however, it is within the scope of the invention that the outriggers are controlled through control unit 14. Additionally, the rotation of the receptor 40 and movement of telescoping mast 18 can be coordinated through control unit 14. The outriggers 48 enable not only the auto-leveling function of crown 38 to work but provides stability and prevents the unit from tipping over. A service technician before delivery calibrates the crown leveling function and the operator at the drill site can turn the function on or off. One or more inclinometers can be mounted on the crown to measure its levelness and send a signal to control unit 14. Typically, at least front to back leveling is measured.

Figure 10:
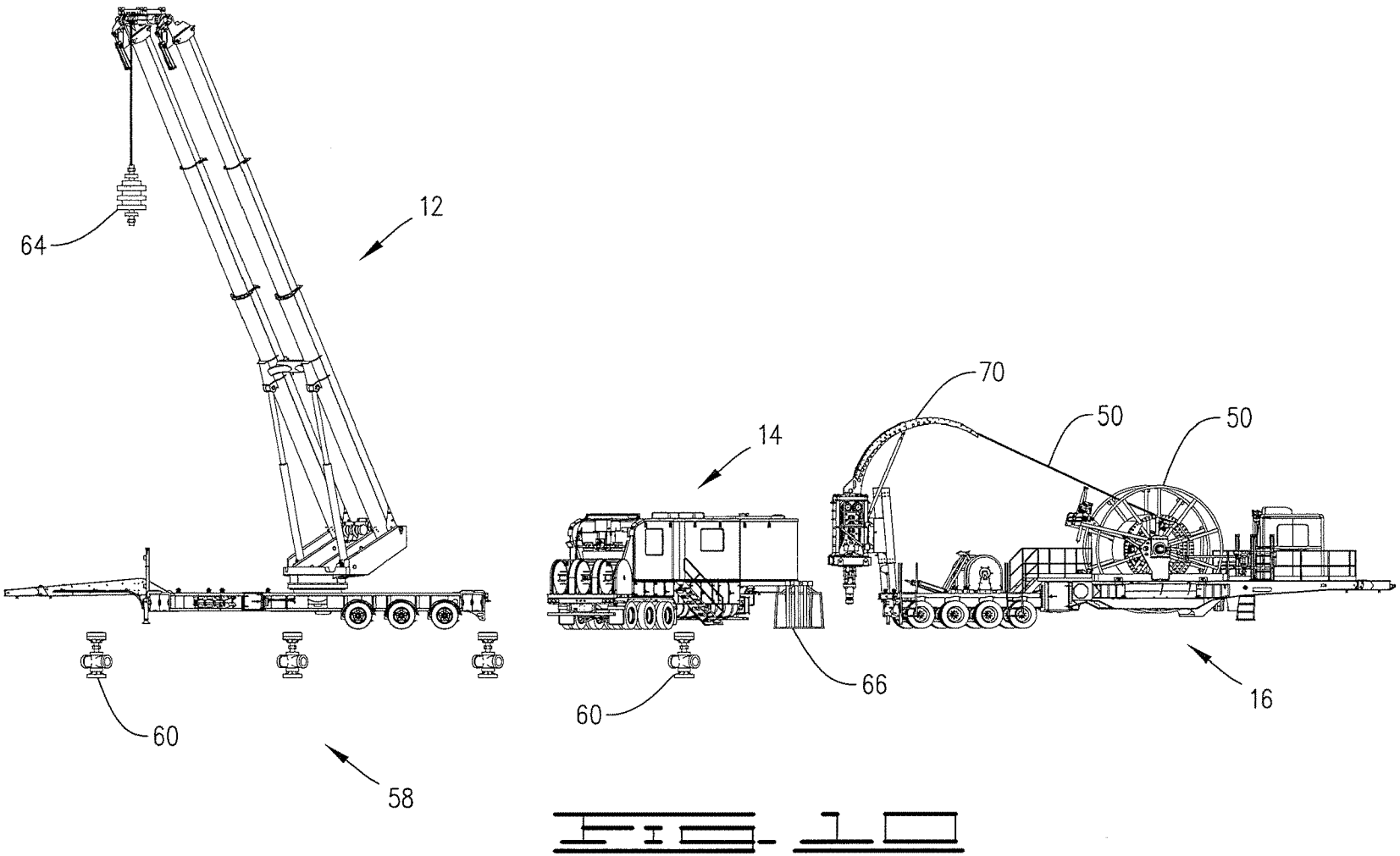
FIG. 10 is a schematic illustration of the mast system as it is being set up for well servicing.

The mast unit 12 location is based on the layout of a group of wells 58 and string height and expected string weight. The group of wells 58 is illustrated in FIGS. 10-16 by a line or row of wellheads 60, which comprise a plurality of wellheads and associated wells. Typically, the mast unit 12 is located to the side of the line of wellheads 60 to be serviced, as illustrated in FIGS. 10. The control unit 14 is typically positioned within the line of sight of the mast unit 12. Other support units, such as the reel trailer or coil unit 16, are positioned appropriately in relation to the wellheads and mast unit 12. Generally, coil unit 16 is positioned in-line with the line of wellheads 60; that is they are positioned at one end or the other of the row or line of wellheads 60. "In-line" as used in the previous sentence means 10 degrees or less from a line extending through the row of wellheads, more typically 5 degrees or less, 2 degrees or less or substantially 0 degrees from the line. However, the coil unit 16 can in some embodiments be placed at an angle from the row of wellheads so that it is out-of-line, that is at an angle greater than 10 degrees from a line extending through the row of wellheads. Coil unit 16 is positioned in-line with the wellheads 60 such that the row of wellheads 60 lie generally along a line tangential to the direction of rotation of the reel. Additional units such as pumpers can be positioned as needed to support the downhole operation.

Once the units have been positioned, the mast system 10 does not have to be moved until wells associated with each wellhead 60 have been serviced. Generally, mast system 10 can service multiple wells without being moved. With the mast system 10 in position, the crown winch 44 is able to hoist the associated tooling, such as BOP 64 and lubricator cradle 66, from a travel position to a work area. Typically, the crown winch is used to hoist the BOP 64 and place it on the first wellhead to be serviced, as shown in FIG, 11.

Figure 11:
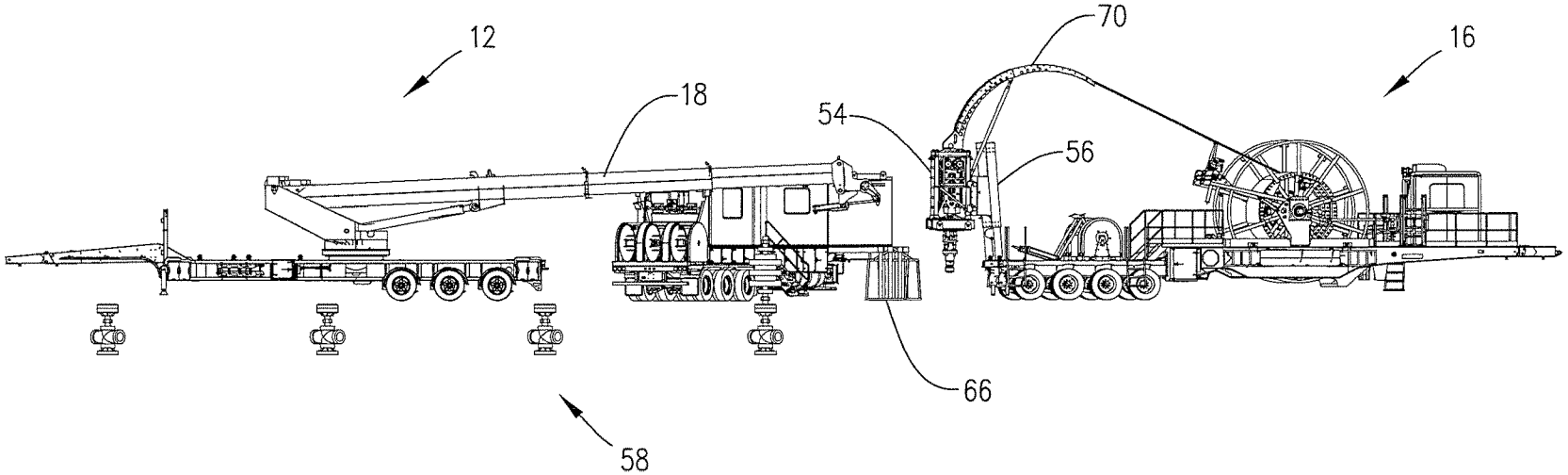
FIG. 11 is another schematic illustration of the mast system as it is being set up for well servicing.

Next, the telescoping mast 18 is telescoped out and tilted down toward injector 54, as can be seen in FIG. 11. In most cases, the injector 54 will be placed on a mini mast 56. During travel, injector 54 remains on mini mast 56 at its lowest position. When the injector 54 is to be mounted in receptor 40 of mast unit 12, the mini mast 56 is moved to a higher position such that injector 54 is raised allowing for crown 38 to engage and lock injector 54 to crown 38 and be rotatably mounted within receptor 40, as shown in FIG. 12. The injector 54 is then unlocked from the mini mast 56 and is lifted towards one of the wellheads 60.

Turning now to FIG. 13, lubricators 66 and associated tooling can be added to the injector 54 as the operator raises the crown 38 and injector 54. The operator raises the injector 54, lubricators 66 and tooling onto the first well 61 with the BOP 64. During placing of injector 54 on first well 61, control unit 14 automatically levels crown 38 so that the injector is oriented to be in-line with first wellhead 6. Thus, injector 54 maintains a vertical injection orientation with respect to first well 61. Additionally, during placement and/or commencement of the coil tubing drilling process, crown 38 is automatically adjusted to be in-line with the reel 52. In other words, crown 38 is automatically adjusted such that injector 54 has an in-line feed orientation with reel 52, such that coiled tubing 50 runs substantially a straight line from reel 52 into gooseneck guide arch 68 of injector 54.

Figure 15:
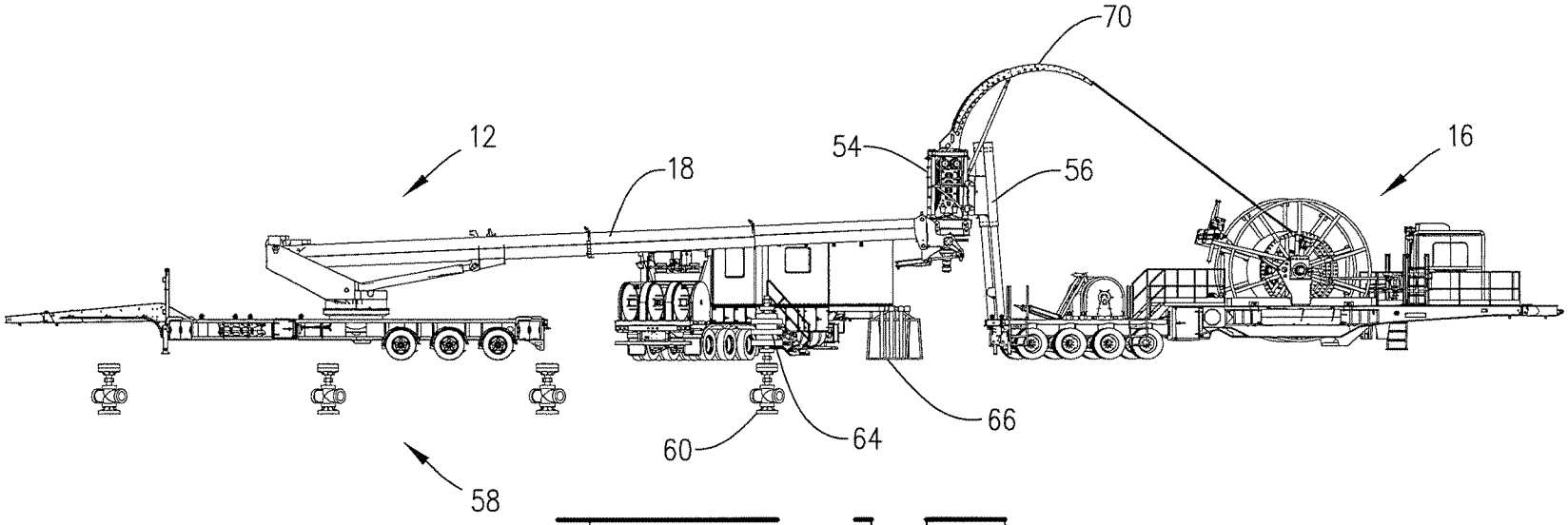
FIG. 15 is a schematic illustration of the mast system as it is servicing a second well in a line of wells.
Figure 15:
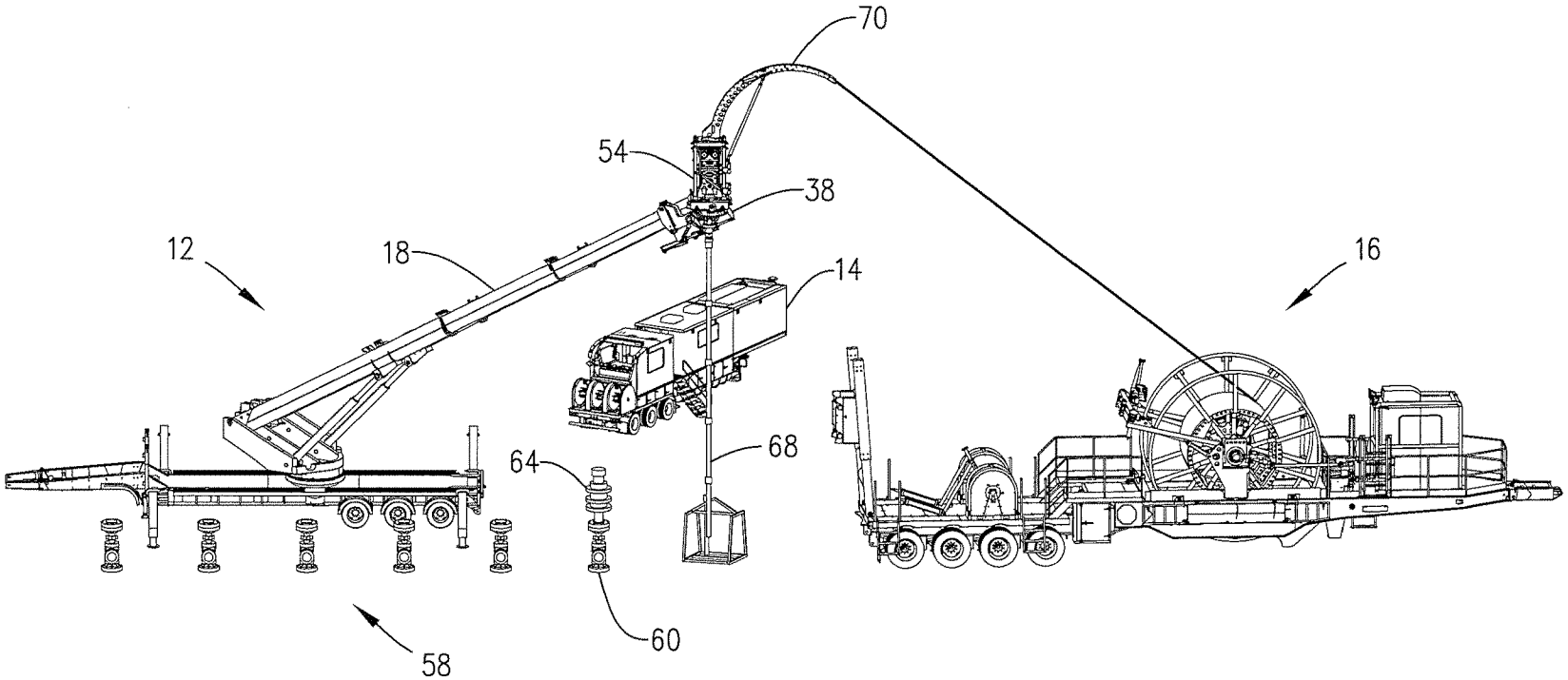
Figure 14:
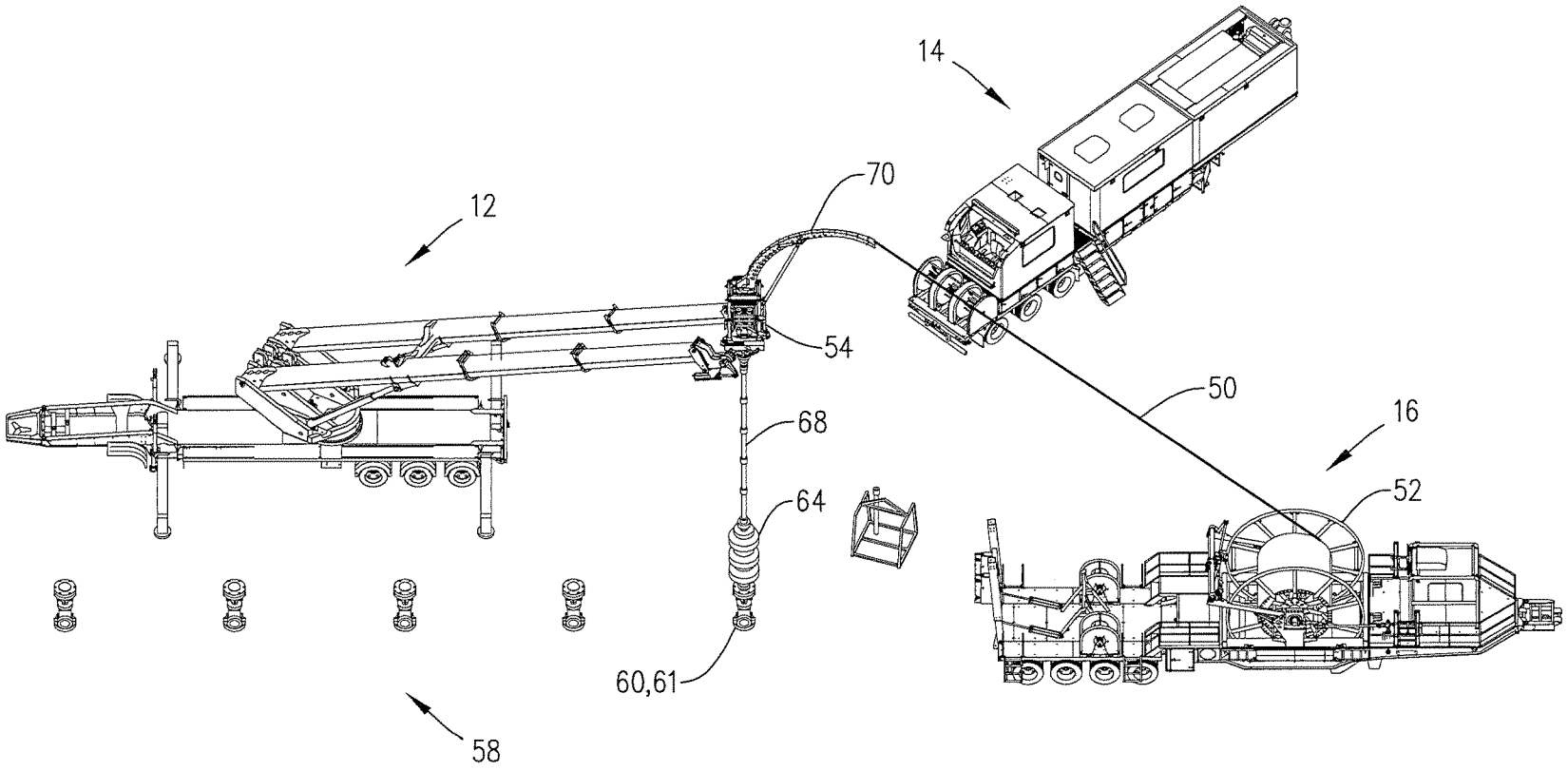
FIG. 14 is a schematic illustration of the mast system as it is servicing a first well in a line of wells.
Figure 15:
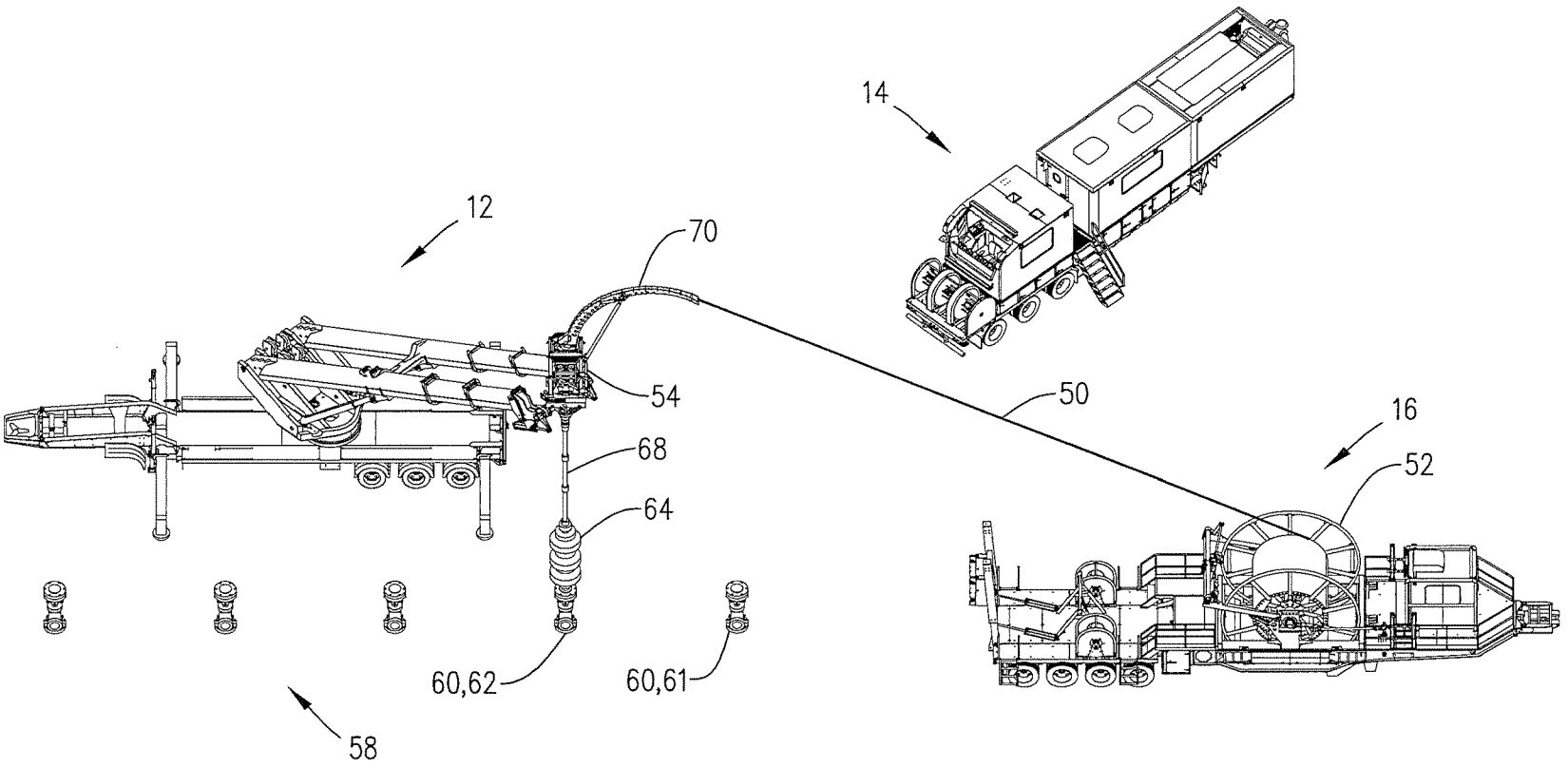
Figure 15:
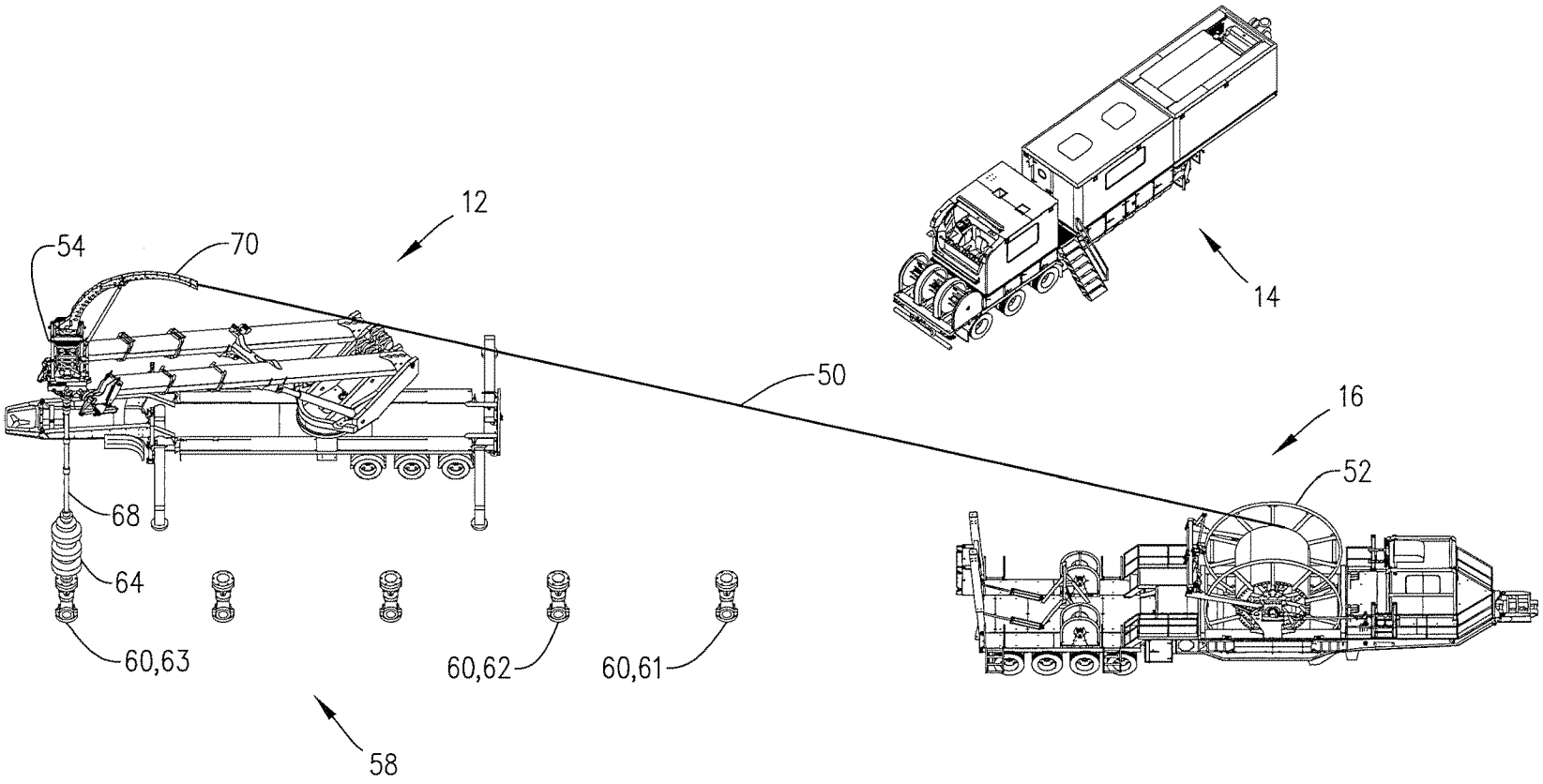

Turning now to FIG. 15, the well string with BOP 64 can be moved over to the next well, second well 62, once the first well 61 has been serviced. Subsequently, the well string can be moved to the other wells in the group of wells 58 until they all have been serviced, ending with the last well 63, as shown in FIG. 16. The well string is moved such that each associated well is serviced without repositioning the mast system 10, including mast unit 12 or any of the support units, such as control unit 14 and coil unit 16. Throughout this drilling process, the control unit 14 insures that injector 54 remains in an in-line feed orientation with the reel by make any necessary vertical, horizontal, tilt and rotation changes. Additionally, control unit 14 insures that injector 54 has an in-line feed orientation with each wellhead so that injector 54 maintains a vertical injection orientation with respect to each well. Once the wells in the group of wells 58 have been serviced and drilling is complete, the BOP 64 can be detached from the string. The string is moved over toward cradle 66 for the tooling and lubricator(s) 68 removal and storage. The injector 54 is then moved back into position on the mini mast 56 or injector stand. The injector 54 is locked into position for travel and unlocked from crown 38. Winch 44 can then be used to replace the lubricator cradle 66 and BOP 64 back into travel position, which can be for example on trailer 20.

Accordingly, the mast system provides for a telescoping mast with 360° rotation and provides for wide a range of service to multiple wells without repositioning mast system 10, including mast unit 12, control unit 14, coil unit 16 and other support units. Since the mast system 10 can service multiple wellheads without relocating, this saves set-up and completion times and increases efficiency. Remote control and automated functions increase site safety and decrease liability and possibility of accidents resulting in personal injury or death. The crown winch provides critical lift solution for the site and set-up functions. The mast system 10 is a mobile unit that provides a large reach (generally up to 90 feet) on a 360° rotating base with an auto-level injector and telescoping mast. This unit provides an easy seamless transfer from wellhead to wellhead without movement of the unit. The auto-level feature allows the injector to remain in line with the reel and the reel trailer (coil unit).

As a further explanation of the operation of the mast system 10, the following steps are typically performed during its use:

(a) The mast trailer is set and the crown is adjusted to level by adjustment of the outriggers.

(b) The mast is extended to the coiled tubing trailer and the injector is mounted in the crown. The injector is already in line with the coiled tubing by its placement on the mini mast.

(c) Prior to moving the mounted injector, the operator zeros the x-y-z position of the crown/injector to enable synchronization of the movement of the telescoping mast and the receptor, hence injector. The operator selects this position as the starting point (zero) and controls the rotation of the crown to insure the injector always faces this direction. The operator has the ability to override this function at any time.

(d) After zeroing, the mast is moved by adjusting its length, rotation and tilt (its radial distance, polar angle and azimuth angle from the base or trailer to place the injector over the first well. Once the operator has selected the starting point, the auto-function will maintain the injector orientation relative to the reel trailer, while the operator raises and extends the booms during the rig up, well treatment and rig down process, to insure the coiled tubing stays in a straight line between the injector and the reel.

(e) During movement a turret encoder tracts the azimuth angle of the crown and injector, a boom angle encoder tracts the polar angle of the telescoping mast and a boom length encoder tracts the telescoping length of the telescoping mast.

(f) The software takes the encoder input and adjusts the rotation of the injector to maintain the correct alignment of the injector with the coiled tubing.

(g) Simultaneously, the auto-leveling occurs to keep the crown level with the ground and hence, the injector of tubing vertical.

(h) Once the injector is aligned with the well, the coiled tubing operation can occur.

(i) After the first well is completed, steps (e)-(h) are carried out for the second and subsequent wells.

As an example of carrying out auto-leveling, the crown can have at least one incliminotoer, typically a single-axis inclinometer, which measures the crown's position relative to the horizon. That value is sent back to the control unit where a programmable logic controller (PLC) uses a proportional-integral-derivative (PID) loop. The PID loop compares the crown's tilt position to zero (or level). The PID loop outputs a positive or negative value indicating the direction the crown needs to move and a speed. That speed is derived in the PID loop and is adjusted as needed depending on the degree of tilt of the platform from level. This iteration can be run hundreds of times per minute, therefore keeping the actual motion of the crown relatively low. However, this part of the program can be shut off and the operator can do manual tilting.

As an example of carrying out auto-rotation, there can be four sensors that are used for the auto-rotation function. Three sensors: (1) turret encoder; (2) boom angle encoder; and (3) boom length encoder, measure the X-Y-Z position of the crown in 3D space relative to the centerline of rotation of the turret (receptor) and the ground. Once the operator puts the crown at the starting point and presses a button, the software can remember that exact X-Y-Z position. After the machine starts moving, two PID loops are used to try to keep the crown or injector within the receptor pointing back at that same point in space. The crown encoder is used as the feedback channel.

Other embodiments will be apparent to those skilled in the art from a consideration of this specification or practice of the embodiments disclosed herein. Thus, the foregoing specification is considered merely exemplary with the true scope thereof being defined by the following claims.

What is claimed is:

1. A method of servicing a well comprising:

(a) mounting a coiled tubing injector onto a mast unit comprising a transportable base, a telescoping mast rotationally mounted upon said base and a crown configured to accept said injector, wherein said telescoping mast is adjustable so as to tilt with respect to said base and said crown is adjustable so as to tilt and rotate said injector;

(b) introducing a tubing from a reel of coiled tubing to said injector;

(c) orienting said injector to be in-line with a first wellhead by one or more of tilting said mast, telescoping said mast and rotating said mast; and (d) orienting said injector by adjustment of said crown, simultaneously with step (c), to maintain an in-line feed orientation of tubing between said injector and said reel.

2. The method of claim 1, further comprising leveling said mast unit prior to introducing said tubing in step (b).

3. The method of claim 1, further comprising, prior to step (c), calibrating said crown with respect to said reel such that a zero point is established in which said injector has said in-line feed orientation with said reel.

4. The method of claim 1, wherein said reel rotates in a direction to provide tubing to said injector and said in-line feed orientation varies no more than 10 degrees from a line tangent to said direction of rotation of said reel.

5. The method of claim 1, further comprising automatically orienting said injector to maintain said in-line feed orientation during orienting said injector to be in-line with said first wellhead.

6. The method of claim 1, further comprising automatically leveling said crown during said orienting said injector to be in-line with said first wellhead such that said injector maintains a vertical injection orientation.

7. The method of claim 1, wherein prior to step (a), said reel is positioned in-line with respect to a row formed by a plurality of wellheads comprising said first wellhead and a second wellhead, and said base is positioned to a side of said row.

8. The method of claim 7, further comprising:

(e) carrying out a coiled tubing operation on said first wellhead;

(f) after step (e), orienting said injector to be in line with said second well by one or more of tilting said mast, telescoping said mast and rotating said mast; and (g) orienting said injector by adjustment of said crown, simultaneously with step (f), to maintain an in-line feed orientation of tubing between said injector and said reel; and (h) carrying out a coiled tubing operation on said second wellhead.

9. The method of claim 8, further comprising repeating steps (f) through (h) for each subsequent wellhead in said row.

10. The method of claim 9, wherein said steps (a) through (h) are carried out without repositioning said base of said mast unit.

11. The method of claim 10, further comprising:

leveling said mast unit prior to introducing said tubing in step (b); and prior to step (c), calibrating said crown with respect to said reel such that a zero point is established in which said injector has said in-line feed orientation with said reel;

automatically orienting said injector to maintain said in-line feed orientation during orienting said injector to be in line with each of said plurality of wellheads; and automatically leveling said crown during orienting said injector to be in line with each of said plurality of wellheads such that said injector maintains a vertical injection orientation; and wherein said reel rotates in a direction to provide tubing to said injector and has an orientation defined by said direction of rotation and said in-line feed orientation varies no more than 10 degrees from said orientation of said reel.

12. A mast system for use in coiled tubing operations, said mast system comprising:

a transportable base;

a telescoping mast having a first end and second end, wherein said first end is rotationally mounted on said base and wherein said mast is pivotally attached to said base such that said mast is adjustable so as to tilt with respect to said base;

a crown having a receptor configured to receive a coiled tubing injector, wherein said receptor is adjustable so as to tilt and rotate with respect to said mast;

a control unit configured to rotate and tilt said receptor in relation to movement of said mast; and said injector and a reel of coiled tubing, said tubing extending into said injector and wherein said control unit is configured to orient said injector by rotating and tilting said receptor to maintain an in-line feed orientation of tubing between said injector and said reel simultaneously with said injector being oriented to be in line with a wellhead by one or more of tilting said mast, telescoping said mast and rotating said mast.

13. The mast system of claim 12, wherein said reel rotates in a direction to provide tubing to said injector and said in-line feed orientation varies no more than 10 degrees from a line tangent to said direction of rotation of said reel.

14. The mast system of claim 13, wherein said control unit is further configured to establish a zero point in which said injector has said in-line feed orientation with said reel.

15. The mast system of claim 12, further comprising a plurality of wellheads including said first wellhead and a second wellhead, wherein said reel is positioned in-line with respect to a row formed by said plurality of wellheads and said base is positioned to a side of said row.

* * * * *